US006960965B2

(12) United States Patent
Rawnick et al.

(10) Patent No.: US 6,960,965 B2
(45) Date of Patent: Nov. 1, 2005

(54) TRANSVERSE MODE CONTROL IN A WAVEGUIDE

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 30 days.

(21) Appl. No.: 10/421,305

(22) Filed: Apr. 23, 2003

(65) Prior Publication Data

US 2004/0212449 A1 Oct. 28, 2004

(51) Int. Cl.[7] ..... H01P 1/22
(52) U.S. Cl. ..... 333/81 B; 333/209
(58) Field of Search ..... 333/81 R, 81 B, 333/208, 209, 211

(56) References Cited

U.S. PATENT DOCUMENTS

| | | | | |
|---|---|---|---|---|
| 3,701,058 | A | | 10/1972 | Smith |
| 4,604,592 | A | * | 8/1986 | Pinson ..... 333/24.1 |
| 4,771,252 | A | * | 9/1988 | Morz et al. ..... 333/1.1 |
| 5,792,236 | A | | 8/1998 | Taylor et al. |
| 6,512,496 | B2 | | 1/2003 | Alexeff et al. ..... 343/915 |
| 6,743,371 | B2 | * | 6/2004 | John et al. ..... 252/62.52 |
| 2003/0160724 | A1 | | 8/2003 | Alexeff et al. ..... 343/701 |
| 2004/0130497 | A1 | | 7/2004 | Alexeff et al. ..... 343/725 |

OTHER PUBLICATIONS

U.S. Appl. No. 10/330,756, filed Dec. 27, 2002, Rawnick et al.
U.S. Appl. No. 10/626,090, filed Jul. 24, 2003, Brown et al.
U.S. Appl. No. 10/632,632, filed Aug. 1, 2003, Rawnick et al.
U.S. Appl. No. 10/625,977, filed Jul. 24, 2003, Rawnick et al.
U.S. Appl. No. 10/614,149, filed Jul. 7, 2003, Brown et al.
U.S. Appl. No. 10/620,483, filed Jul. 16, 2003, Brown et al.
U.S. Appl. No. 10/640,237, filed Aug. 13, 2003, Rawnick et al.
U.S. Appl. No. 10/648,913, filed Aug. 27, 2003, Brown et al.
U.S. Appl. No. 10/414,695, filed Apr. 16, 2003, Rawnick et al.
U.S. Appl. No. 10/460,947, filed Jun. 13 2003, Rawnick et al.
U.S. Appl. No. 10/648,887, filed Aug. 27, 2003, Rawnick et al.

* cited by examiner

*Primary Examiner*—Stephen E. Jones
(74) *Attorney, Agent, or Firm*—Sacco & Associates, PA

(57) ABSTRACT

A waveguide apparatus (100) includes a waveguide attenuator portion (102) having at least one waveguide cavity (109) and a conductive fluid (108) at least partially disposed within a waveguide cavity (104). At least one composition processor (101) is included and adapted for at least one among an electrical characteristic and a physical characteristic of the mode controlled waveguide by manipulating the conductive fluid to vary at least one among a volume, shape and a composition. A controller (136) is provided for controlling the composition processor in response to a waveguide mode control signal (137).

23 Claims, 5 Drawing Sheets

TRANSVERSE MODE CONTROL IN A WAVEGUIDE

BACKGROUND OF THE INVENTION

1. Statement of the Technical Field

The inventive arrangements relate generally to methods and apparatus for providing increased design flexibility for RF circuits, and more particularly to controlling modes within a waveguide.

2. Description of the Related Art

A waveguide typically includes a material medium that confines and guides a propagating electromagnetic wave. In the microwave regime, a waveguide normally consists of a hollow metallic conductor, usually rectangular, elliptical, or circular in cross-section. This type of waveguide may, under certain conditions, contain a solid or gaseous dielectric material.

In a waveguide or cavity, a "mode" is one of the various possible patterns of propagating or standing electromagnetic fields. Each mode is characterized by frequency, polarization, electric field strength, and magnetic field strength. The electromagnetic field pattern of a mode depends on the frequency, refractive indices or dielectric constants, and waveguide or cavity geometry. With low enough frequencies for a given structure, no mode will be supported. At higher frequencies, higher modes are supported and will tend to limit the operational bandwidth of a waveguide. Each waveguide configuration can form different modes of operation. The easiest mode to produce is called the Dominant Mode. Other modes with different field configurations may occur accidentally or may be caused deliberately. Hence, it may be desirable to suppress certain higher modes by providing a particular waveguide structure that slightly attenuates in a desired mode while significantly attenuating an undesired mode or modes.

An "evanescent field" in a waveguide is a time-varying field having an amplitude that decreases monotonically as a function of transverse radial distance from the waveguide, but without an accompanying phase shift. The evanescent field is coupled, i.e., bound, to an electromagnetic wave or mode propagating inside the waveguide. In other words, an evanescent mode can be a signal below a cut-off frequency that propagates through the waveguide to a given extent and becomes weaker as it traverses through the waveguide.

Variable waveguide attenuators are commonly used to attenuate microwave signals propagating within a waveguide, which is a type of transmission line structure commonly used for microwave signals. Waveguides typically consist of a hollow tube made of an electrically conductive material, for example copper, brass, steel, etc. Further, waveguides can be provided in a variety of shapes, but most as previously mentioned often are cylindrical or have a rectangular cross section. In operation, waveguides propagate modes above a certain cutoff frequency.

Waveguide attenuators are available in a variety of arrangements. In one arrangement, the waveguide attenuator consists of three sections of waveguide in tandem: a middle section and two end sections. In each section a resistive film is placed across an inner diameter of the waveguide (in the case of a waveguide having a circular cross section) or across a width of the waveguide (in the case of a waveguide having a rectangular cross section). In either case, the resistive film collinearly extends the length of each waveguide section. The middle section of the waveguide is free to rotate radially with respect to the waveguide end sections. When the resistive film in the three sections are aligned, the E-field of an applied microwave signal is normal to all films. When this occurs, no current flows in the films and no attenuation occurs. When the center section is rotated at an angle θ with respect to the end section at the input of the waveguide, the E field can be considered to split into two orthogonal components, E sin θ and E cos θ. E sin θ is in the plane of the film and E cos θ is orthogonal to the film. Accordingly, the E sin θ component is absorbed by the film and the E cos θ component is passed unattenuated to the end section at the output of the waveguide. The resistive film in the end section at the output then absorbs the E cos θ sin θ component of the E field and an E $\cos^2$ θ component emerges from the waveguide at the same orientation as the original wave. The accuracy of such an attenuator is dependant on the stability of the resistive films. If the resistive films should degrade over time, performance of the waveguide attenuator will be affected. Further, energy reflections and higher-order mode propagation commonly occur in such a waveguide attenuator design.

In another arrangement, a wedge shaped waveguide attenuator having resistive surfaces exists. Because the waveguide attenuator is wedge shaped, the E field again can be considered to split into two orthogonal components at each surface of the wedge, E sin θ and E cos θ. As with the previous example, the E sin θ component of a microwave signal is absorbed by the film. However, the tapered portion of the waveguide attenuator causes energy reflections to occur. Hence, the wedge shaped waveguide attenuator must be long enough to obtain sufficiently low reflection characteristics. Accordingly, this type of waveguide attenuator is limited to use in relatively long waveguides. Thus, a need exists for a waveguide and a waveguide attenuator that provides additional design flexibility and overcomes the limitations described above with respect to existing waveguides and waveguide attenuators.

A waveguide will have field components in the x, y, and z directions. A waveguide will typically have waveguide dimensions of width, height and length represented by a, b, and l respectively. There are no z-directed currents in the short walls of the waveguide (either for propagating mode or evanescent mode), so the short wall does not need to be continuous in the z-direction. Thus, an array of vertical (y-directed) wires would alternatively work as well. The cutoff frequency or cutoff wavelength (for transverse electric (TE) modes) can be represented as:

$$(f_c)_{mn} = \frac{1}{2\pi\sqrt{\mu\varepsilon}}\sqrt{\left(\frac{m\pi}{a}\right)^2 + \left(\frac{n\pi}{b}\right)^2}$$

and $$(\lambda_c)_{mn} = \frac{2}{\sqrt{\left(\frac{m}{a}\right)^2 + \left(\frac{n}{b}\right)^2}}$$

where a, b are waveguide dimensions as shown in FIG. 5, c is the speed of light, $\epsilon$ and $\mu$ describes the dielectric inside the waveguide and m, n are mode numbers. The lowest frequency mode $TE_{10}$ (m=1, n=0) is also known as the dominant mode and provides the most efficient mode for propagation. The dominant mode for rectangular waveguides is designated as the TE mode because the E fields are perpendicular to the "a" walls. The first subscript is 1 since there is only one half-wave pattern across the "a" dimension. There are no E-field patterns across the "b" dimension, so the second subscript is 0. The complete mode description of the dominant mode in rectangular waveguides is $TE_{1,0}$. Waveguides are normally designed so that only the dominant mode will be used. To operate in the dominant mode, a waveguide must have an "a" (wide) dimension of at least one half-wavelength of the frequency to be propagated. In rectangular waveguides, the first subscript indicates the number of half-wave patterns in the "a" dimension, and the second subscript indicates the number of half-wave patterns in the "b" dimension. The "a" dimension of the waveguide must be kept near the minimum allowable value to ensure that only the dominant mode will exist. In practice, this dimension is usually 0.7 wavelength. The high-frequency limit of a rectangular waveguide is a frequency at which its "a" dimension becomes large enough to allow operation in a mode higher than that for which the waveguide has been designed. Thus, a need exists to dynamically adjust the dimension of a waveguide in certain scenarios.

The field arrangements of the various modes of operation are divided into two categories: Transverse electric (TE) and Transverse Magnetic (TM). In the transverse electric (TE) mode, the entire electric field is in the transverse plane, which is perpendicular to the length of the waveguide (direction of energy travel). Part of the magnetic field is parallel to the length axis. In the transverse magnetic (TM) mode, the entire magnetic field is in the transverse plane and has no portion parallel to the length axis. Since there are several TE and TM modes, subscripts are used to complete the description of the field pattern.

A similar system is used to identify the modes of circular waveguides. The general classification of TE and TM is true for both circular and rectangular waveguides. In circular waveguides the subscripts have a different meaning. The first subscript indicates the number of full-wave patterns around the circumference of the waveguide. The second subscript indicates the number of half-wave patterns across the diameter. In the circular waveguide, the E field is perpendicular to the length of the waveguide with no E lines parallel to the direction of propagation. Thus, it must be classified as operating in the TE mode. If you follow the E line pattern in a counterclockwise direction starting at the top, the E lines go from zero, through maximum positive (tail of arrows), back to zero, through maximum negative (head of arrows), and then back to zero again. This is one full wave, so the first subscript is 1. Along the diameter, the E lines go from zero through maximum and back to zero, making a half-wave variation. The second subscript, therefore, is also 1. $TE_{1,1}$ is the complete mode description of the dominant mode in circular waveguides. Several modes are possible in both circular and rectangular waveguides.

SUMMARY OF THE INVENTION

The present invention relates to a waveguide and methods for controlling modes therein. The waveguide includes at least one waveguide attenuator cavity and a conductive fluid at least partially disposed within at least one among the waveguide attenuator cavity and at least one subcavity within the waveguide attenuator cavity. At least one composition processor is included and adapted for changing a composition or a volume of the conductive fluid to change at least one among an electrical characteristic and a physical characteristic of the waveguide. A controller is provided for controlling the composition processor to selectively vary the volume, shape, loss tangent, the permittivity and/or the permeability in response to a waveguide mode control signal.

The composition processor can selectively vary the volume and/or loss tangent (or permeability or permittivity) to vary the attenuation, physical dimensions, or electrical properties of the waveguide. The composition processor also can selectively vary the permeability and/or volume to maintain the characteristic impedance approximately constant when at least one of the loss tangent and the permittivity is varied. Further, the composition processor can selectively vary the permittivity and/or volume to maintain the characteristic impedance approximately constant when at least one of the loss tangent and the permeability is varied. Further, the permittivity and/or the permeability can be adjusted to adjust the characteristic impedance.

A plurality of component parts can be dynamically mixed together in the composition processor in response to the waveguide attenuator control signal to form the conductive fluid. The composition processor can include at least one proportional valve, at least one mixing pump, and at least one conduit for selectively mixing and communicating a plurality of the components of the conductive fluid from respective fluid reservoirs to a waveguide cavity or a subcavity of the waveguide cavity. The composition processor can further include a component part separator adapted for separating the component parts of the conductive fluid for subsequent reuse.

The component parts can be selected from the group consisting of (a) a low permittivity, low permeability, low loss component, (b) a high permittivity, low permeability, low loss component, and (c) a high permittivity, high permeability, high loss component. In another arrangement, the component parts can be selected from the group consisting of (a) a low permittivity, low permeability, low loss component, (b) a high permittivity, low permeability, low loss component, (c) a high permittivity, high permeability, low loss component, and (d) a low permittivity, low permeability, high loss component. The conductive fluid can include an industrial solvent which can have a suspension of magnetic particles contained therein. The magnetic particles can consist of ferrite, metallic salts, and organo-metallic particles. In one arrangement, waveguide cavity can contain about 50% to 90% magnetic particles by weight.

DETAILED DESCRIPTION OF THE PREFERRED EMBODIMENTS

The present invention provides the circuit designer with an added level of flexibility by permitting a conductive fluid to be used in a waveguide, thereby enabling the manipulation of physical dimensions as well as electrical characteristics such as attenuation and impedance characteristics of the waveguide. Particles having a high loss tangent can be provided in the conductive fluid and the particle density can be adjusted to vary the attenuation. Several high loss dielectric fluids exist. Examples include the Ferrotec EMG series, specifically EMG805, EMG807 and EMG1111. Examples of lossy particles include ferrite powder and cobalt powder, both available in micron-sized particles suitable for use in suspensions. Lossy fluids such as the aforementioned Ferrotec liquids would probably be a better choice since they are more likely to form a homogeneous mix as opposed to a particle suspension of Fe or Co.

Further, the permittivity ($\in$) and/or permeability ($\mu$) of the conductive fluid can be adjusted to change the impedance of the waveguide or to maintain a constant impedance as the particle density is adjusted. For example, the impedance of the waveguide attenuator can be precisely matched to the impedance of a waveguide by maintaining a constant ratio of $\in_r/\mu_r$, where $\in_r$ is the relative permittivity of the fluidic dielectric, and $\mu_r$ is the relative permeability of the fluidic dielectric. A precisely matched impedance can minimize energy reflections caused by a transition from an unattenuated portion of the waveguide to a waveguide attenuator for example. A precisely matched impedance also reduces higher-order mode propagation. The volume and/or shape of the waveguide attenuator can also be adjusted using fluidics. In other words, a dielectric fluid can be used to alter the electrical size while a conductive fluid could be used alter the physical size or shape of the waveguide attenuator to provide tunable cut-off frequencies, attenuators, filters as well as mode control or suppression.

Figure 1:
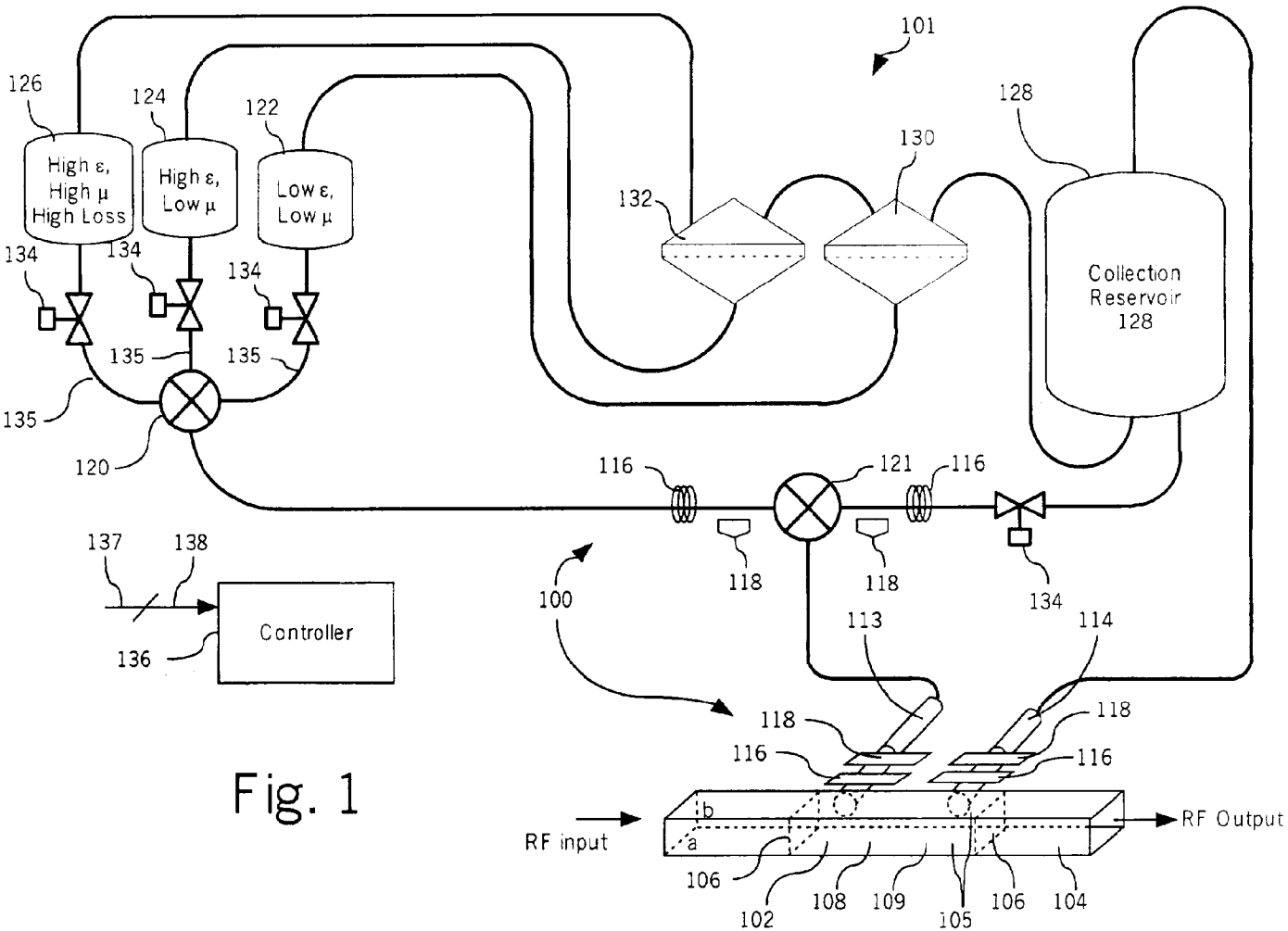
FIG. 1 is a block diagram useful for understanding the waveguide of the present invention.

FIG. 1 is a conceptual diagram that is useful for understanding the mode controlled waveguide apparatus 100 of the present invention. The apparatus 100 can vary the characteristics of the waveguide attenuator portion 102 of the waveguide 104, which comprises an attenuator cavity region 109 contained within the waveguide 104. The cavity region 109 is filled with a conductive fluid 108 to primarily alter the physical dimensions of the waveguide 104 and alternatively to vary attenuation characteristics, permittivity and/or permeability of the waveguide attenuator portion 102 by either varying the composition or volume of conductive fluid within the cavity region 109. Note that In the orientation shown, as attenuator cavity region 109 fills with conductive fluid 108, the "b" dimension of the waveguide attenuator portion 109 becomes effectively smaller. If the waveguide 104 is rotated in another direction, the "a" dimension becomes smaller as the attenuator cavity region 109 fills with conductive fluid 108. The waveguide 104 can be any structure capable of supporting propagation modes and not limited to the rectangular structure shown. Waveguides are commonly embodied as electrically conductive tubes having circular or rectangular cross sections, but the present invention is not so limited; the present invention can be incorporated into any type of waveguide having any desired shape. For example, the present invention can be incorporated into a waveguide comprising circuit traces on a dielectric substrate and a plurality of rows of conductive vias which cooperatively support propagation modes. In such an example, at least one cavity for containing conductive fluid can be positioned between adjacent rows of conductive vias. Additional vias having one end which couples to the cavity can be provided as a pathway for the flow of fluidic dielectric in and gut of the cavity.

The waveguide attenuator portion 102 can be located anywhere within the waveguide 104. For example, the waveguide attenuator portion 102 can be located in a central location within the waveguide 104 at either end of the waveguide 104, or anywhere in between. Further, multiple waveguide attenuator cavities (see FIGS. 2 and 3) can be included in a single waveguide, for instance to provide an option of cascading waveguide filters within the waveguide 104. In one arrangement, successive cavities can be filled with conductive fluid to achieve levels of attenuation higher than might be achieved by merely varying the composition of the conductive fluid in a single cavity. For example, a plurality of waveguide attenuator cavities each providing a range of attenuation levels of approximately 0–10 dB can be provided. Loss could be adjusted by both changes in the fluid as well as change in length of the waveguide section. If 18 dB of attenuation is needed, the attenuation of two waveguide filter cavities can be adjusted to be 9 dB. Alternatively, a first waveguide attenuator cavity can be adjusted to provide 10 dB of attenuation while the second waveguide attenuator cavity is adjusted to provide 8 dB of attenuation. Still, a myriad of combinations of waveguide filter cavities and attenuation levels can be used, any of which are within the scope of the present invention.

Although the shape of the waveguide attenuator portion 102 is primarily controlled by the shape of the cavity region 109, the waveguide attenuator portion 102 can incorporate other objects which protrude within the cavity 109. For example, tuning screws can protrude into the cavity region 109 to vary RF propagation characteristics within the cavity. Further, the cavity region 109 can comprise adjustable barriers and/or other objects which can change the RF response of the waveguide attenuator portion 102. Likewise, the control of volume of conductive fluid within the cavity region 109 or regions can also alter the response of the waveguide attenuator. In particular, changing the dimensions and/or volume of fluid within the cavity region 109 can change the frequency of modes supported within cavity region 109 Ideally, a conductive fluid can be placed in the cavity region 109 to minimize attenuation of a dominant mode while attenuating all other higher order modes. Alternatively, the conductive fluid could be placed in the cavity region 109 such that a particular higher order mode is left primarily unattenuated while all other higher order modes and the dominant mode is attenuated to provide a notched response.

Notably, the waveguide attenuator portion 102 can be provided in a variety of shapes. For example, the waveguide attenuator can be bounded on four sides by the walls 105 of the waveguide 104 and bounded on two sides by barriers 106. Preferably, the barriers are made of a dielectric material so as not to disrupt waveguide performance. In other arrangements the cavity 109 can be arranged in more complex shapes, for example a wedge shape.

Figure 3:
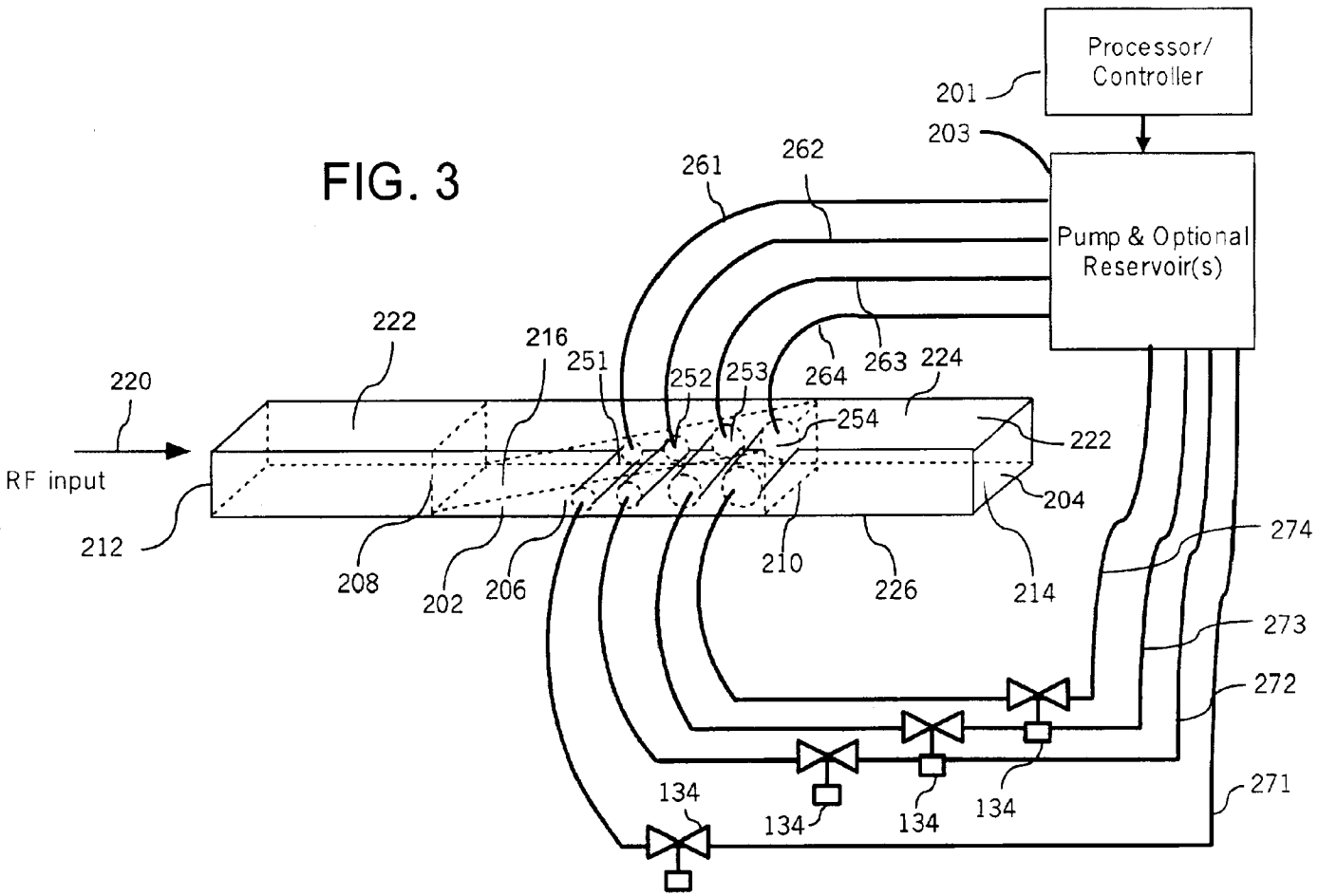
FIG. 3 is a block diagram of yet another waveguide having an alternate shape.

A wedge shape, as shown in FIG. 3, can be particularly useful to minimize reflection of an RF signal 220 due to the waveguide attenuator portion 202, for example, when there is an impedance mismatch between the waveguide attenuator portion 202 and the remaining dielectric 222 within a waveguide 204. Such an impedance mismatch can occur when the waveguide attenuator portion 202 has a different characteristic impedance than the remaining dielectric 222. The waveguide attenuator portion 202 can be positioned with a narrow end 208 oriented towards an end 212 of the waveguide 204 receiving RF input 220 and a wide end 210 of the waveguide attenuator portion 202 towards an output end 214 of the wavegude 204. Since there is a large angle of incidence between the RF signal 220 and a diagonal barrier 216, very little signal energy will be reflected towards the input end 212. Further, since the depth of the waveguide cavity 206 varies along the length of the waveguide attenuator 202, the amount of lossy fluid existing within cavities or chambers 251, 252, 253, and 254 between opposing waveguide walls 224 and 226 will vary. Accordingly, the attenuation of the waveguide attenuator 202 will vary over its' length. The change in attenuation should be taken into consideration when computing the overall net attenuation of the waveguide attenuator portion 202. A controller 201 containing look-up tables for controlling a pump 203 or multiple pumps as well as a reservoir or reservoirs in conjunction with valves 134 can shift volumes of fluidic dielectric to an from the chambers via corresponding input conduits 261, 262, 263, and 264 and output conduits 271, 272, 273, and 274. Note that chambers or cavities 251–254 vary in volume and that the present invention is not limited to a particular number of cavities. The greater the number of cavities in this regard the more "fine tuning" that will be available.

Referring again to FIG. 1, a composition processor 101 is provided for changing a composition or volume of the conductive fluid 108 to vary the physical and/or electrical characteristics of the waveguide. Further, it is preferable that the composition processor 101 also change the composition of the conductive fluid 108 to vary permittivity and/or permeability in order to maintain control over the characteristic impedance of the waveguide attenuator 102. A controller 136 controls the composition processor for selectively varying the attenuation, permittivity and/or permeability of the conductive fluid 108 in response to a waveguide mode signal 137 on control input line 138. By selectively varying the volume, attenuation, permittivity and/or permeability of the conductive fluid, the controller 136 can control attenuation of an RF signal, for example a microwave signal, through the waveguide 104 as well as group velocity of the RF signal. Further, the controller 136 can control the Impedance of the waveguide 104 within the cavity region 109.

Composition of Conductive Fluid

The conductive fluid can be comprised of several component parts that can be mixed together to produce a desired propagating mode as well as attenuation, permittivity and permeability required for particular waveguide attenuator characteristics. In this regard, it will be readily appreciated that fluid miscibility and particle suspension are key considerations to ensure proper mixing. Another key consideration is the relative ease by which the component parts can be subsequently separated from one another. The ability to separate the component parts is important when the attenuation or impedance requirements change. Specifically, this feature ensures that the component parts can be subsequently re-mixed in a different proportion to form a new conductive fluid.

It may be desirable in many instances to select component mixtures that produce a conductive fluid that has a relatively constant response over a broad range of frequencies. If the conductive fluid is not relatively constant over a broad range of frequencies, the characteristics of the fluid at various frequencies can be accounted for when the conductive fluid is mixed. For example, a table of loss tangent, permittivity and permeability values vs. frequency can be stored in the controller 136 for reference during the mixing process.

Aside from the foregoing constraints, there are relatively few limits on the range of component parts that can be used to form the conductive fluid. Accordingly, those skilled in the art will recognize that the examples of component parts, mixing methods, volume distribution methods, and separation methods as shall be disclosed herein are merely by way of example and are not intended to limit in any way the scope of the invention. Also, the component materials are described herein as being mixed in order to produce the conductive fluid. However, it should be noted that the invention is not so limited. Instead, it should be recognized that the composition of the conductive fluid could be modified in other ways. For example, the component parts could be selected to chemically react with one another in such a way as to produce the conductive fluid with the desired values of permittivity and/or permeability. All such techniques will be understood to be included to the extent that it is stated that the composition or volume of the conductive fluid is changed.

A nominal value of permittivity ($\in_r$) for fluids is approximately 2.0. However, the component parts for the conductive fluid can include fluids with extreme values of permittivity. Consequently, a mixture of such component parts can be used to produce a wide range of intermediate permittivity values. For example, component fluids could be selected with permittivity values of approximately 2.0 and about 58 to produce a conductive fluid with a permittivity anywhere within that range after mixing. Dielectric particle suspensions can also be used to increase permittivity and loss tangent.

According to a preferred embodiment, the component parts of the conductive fluid can be selected to include (a) a low permittivity, low permeability, low loss component and (b) a high permittivity, high permeability, high loss component. These two components can be mixed as needed for increasing the loss tangent while maintaining a relatively constant ratio of permittivity to permeability. A third component part of the conductive fluid can include (c) a high permittivity, low permeability, low loss component for allowing adjustment of the permittivity of the fluidic dielectric independent of the permeability. Still, a myriad of other component mixtures can be used. For example, the following conductive fluid components can be provided: (a) a low permittivity, low permeability, low loss component, (b) a high permittivity, low permeability, low loss component, (c) a high permittivity, high permeability low loss component, and (d) a low permittivity, low permeability, high loss component.

High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organo-metallic compounds, and other derivatives, although Fe and Co particles are most common. The size of the magnetic particles found in such systems is known to vary to some extent. However, particles sizes in the range of 1 nm to 20 $\mu$m are common. The composition of particles can be varied as necessary to achieve the required range of permeability in the final mixed fluidic dielectric after mixing. However, magnetic fluid compositions are typically between about 50% to 90% particles by weight. Increasing the number of particles will generally increase the permeability.

An example of a set of component parts that could be used to produce a conductive fluid as described herein would include oil (low permittivity, low permeability and low loss), a solvent (high permittivity, low permeability and low loss), and a magnetic fluid, such as combination of an oil and a ferrite (low permittivity, high permeability and high loss). Further, certain ferrofluids also can be used to introduce a high loss tangent into the conductive fluid, for example those commercially available from FerroTec Corporation of Nashua, NH 03060. In particular, Ferrotec part numbers EMG0805, EMG0807, and EMG1111 can be used. A hydrocarbon dielectric oil such as Vacuum Pump Oil MSDS-12602 could be used to realize a low permittivity, low permeability, and low loss tangent fluid. A low permittivity, high permeability fluid may be realized by mixing the hydrocarbon fluid with magnetic particles or metal powders which are designed for use in ferrofluids and magnetorestrictive (MR) fluids. For example magnetite magnetic particles can be used. Magnetite is also commercially available from FerroTec Corporation. An exemplary metal powder that can be used is iron-nickel, which can be provided by Lord Corporation of Cary, N.C. Fluids containing electrically conductive magnetic particles require a mix ratio low enough to ensure that no electrical path can be created in the mixture. Additional ingredients such as surfactants can be included to promote uniform dispersion of the particles. High permittivity can be achieved by incorporating solvents such as formamide, which inherently posses a relatively high permittivity. Fluid Permittivity also can be increased by adding high permittivity powders such as Barium Titanate manufactured by Ferro Corporation of Cleveland, Ohio. For broadband applications, the fluids would not have significant resonances over the frequency band of interest.

Processing of Conductive Fluid for Mixing/Unmixing of Components

The composition processor 101 can be comprised of a plurality of fluid reservoirs containing component parts of conductive fluid 108. These can include: a first fluid reservoir 122 for a low permittivity, low permeability component of the conductive fluid; a second fluid reservoir 124 for a high permittivity, low permeability component of the conductive fluid; a third fluid reservoir 126 for a high permittivity, high permeability, high loss component of the conductive fluid. Those skilled in the art will appreciate that other combinations of component parts may also be suitable and the invention is not intended to be limited to the specific combination of component parts described herein. For example, the third fluid reservoir 126 can contain a high permittivity, high permeability, low loss component of the conductive fluid and a fourth fluid reservoir can be provided to contain a component of the conductive fluid having a high loss tangent.

A cooperating set of proportional valves 134, mixing pumps 120, 121, and connecting conduits 135 can be provided as shown in FIG. 1 for selectively mixing and communicating the components of the conductive fluid 108 from the fluid reservoirs 122, 124, 126 to cavity 109. The composition processor also serves to separate out the component parts of conductive fluid 108 so that they can be subsequently re-used to form the conductive fluid with different attenuation, permittivity and/or permeability values. All of the various operating functions of the composition processor can be controlled by controller 136. The operation of the composition processor shall now be described in greater detail with reference to FIG. 1 and the flowchart shown in FIG. 4.

Figure 4:
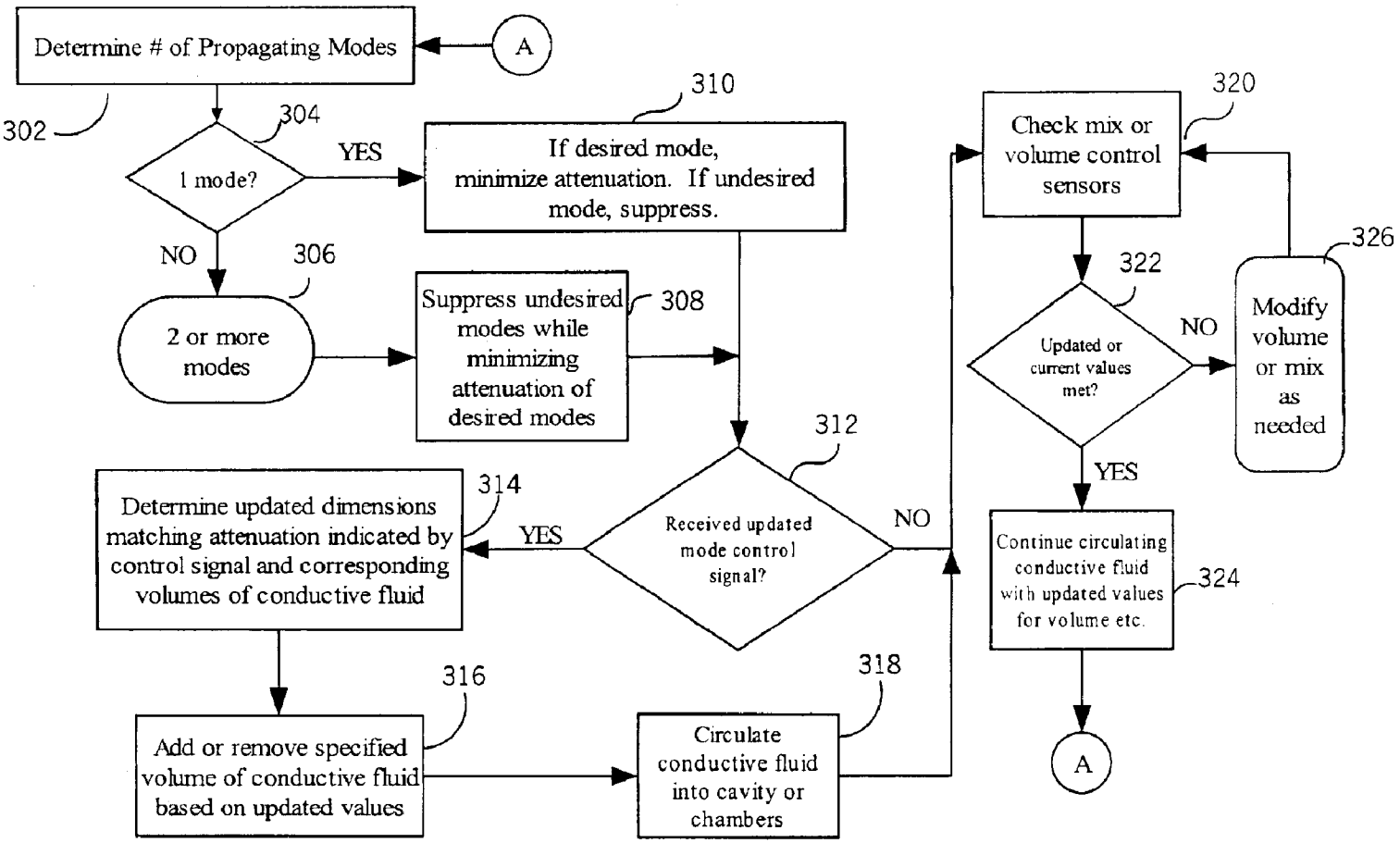
FIG. 4 is a flow chart that is useful for understanding the process of the invention.
Figure 5:
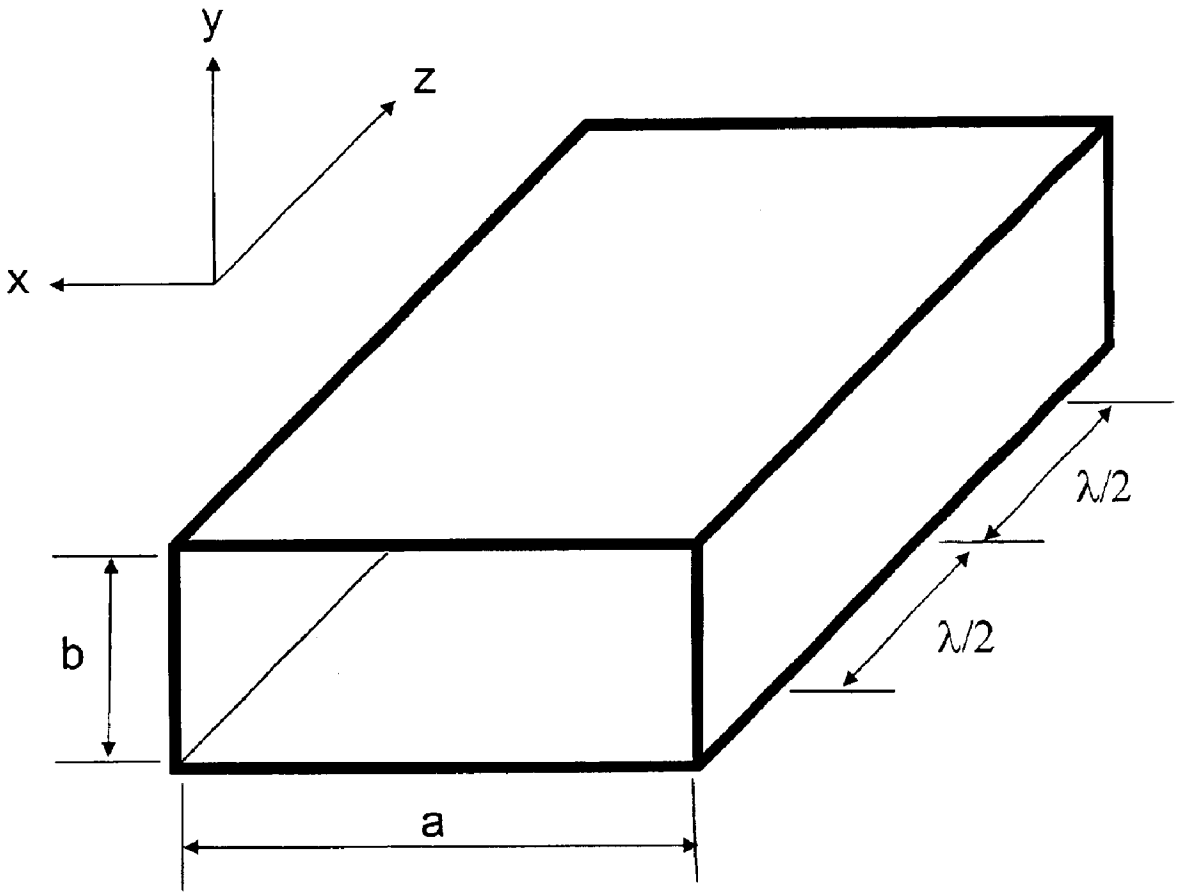
FIG. 5 is a rectangular waveguide for understanding the concept of control mode in accordance with the present invention.

The process can begin in step 302 of FIG. 4 where it is determined (apriori, if needed) how many modes will propagate for a given structure and signal. If a single mode is determined to propagate at decision block 304 then attenuation for the given mode is minimized unless the single mode is undesired for a particular application at step 310. In the mode is undesired, then it can be suppressed. If more than one mode is found at decision block 304 then two or more higher order modes are indicated at block 304. In such instance, undesired modes (typically the higher order modes) are suppressed while desired modes (typically the dominant mode) have minimized attenuation at step 308. At step 312, controller 136 checks to see if an updated waveguide mode control signal 137 has been received on an input line 138. If no updated signal is provided at decision block 312, then volume and/or mix (composition) sensors can be checked at block 320. If an updated mode control signal is received at decision block 312, then the process continues on to step 314 to determine updated dimensions matching attenuation indicated by the waveguide mode control signal 137 and corresponding to specified volumes and/or shapes of conductive fluid. The updated values necessary for achieving the indicated attenuation and/or volumes can be determined using a look-up table. At step 316, specific volumes of conductive fluids can be added or removed (or mixed) based upon the updated values. At step 318, conductive fluid would then be circulated as needed into the appropriate cavities or chambers of the waveguide. Subsequently the volume and/or mix sensor are check at step 320. If the updated values are met at decision block 322, the conductive fluids continue to be circulated as needed with the updated values in the appropriate chambers or cavities at step 324 and the process returns to the beginning. If the updated values have not been met at decision block 322, then volumes or mixtures of the conductive fluid are modified as needed to meet the indicated updated values at step 326, whereupon sensors are checked at step 320 until the updated values are met.

In step 316, the controller can determine an updated permittivity value for matching the characteristic impedance indicated by the waveguide mode control signal 137. For example, the controller 136 can determine the permeability of the fluidic components based upon the fluidic component mix ratios and determine an amount of permittivity that is necessary to achieve the indicated impedance for the determined permeability.

The controller 136 can cause the composition processor 101 to begin mixing two or more component parts in a proportion to form fluidic dielectric that has the updated loss tangent and permittivity values determined earlier. Alternatively or in conjunction with mixing, the composition processor 101 can also begin altering specified volumes of fluidic dielectric to or from one or more cavities or chambers within the waveguide to compensate for the previously determined updated values. In the case that the high loss component part also provides a substantial portion of the permeability in the conductive fluid, the permeability will be a function of the amount of high loss component part that is required to achieve a specific attenuation. However, in the case that a separate high permeability fluid is provided as a high permeability component part, the permeability can be determined independently of the loss tangent. This mixing process and/or volume shifting can be accomplished by any suitable means. For example, in FIG. 1 a set of proportional valves 134 and mixing pump 120 are used to mix component parts from reservoirs 122, 124, 126 appropriate to achieve the desired updated loss tangent, permittivity and permeability values.

In step 320, the controller checks one or more sensors 116, 118 to determine if the conductive fluid being circulated through the cavity 109 has the proper values of loss tangent, permittivity and permeability or to determine proper volumes corresponding to the previously determined updated values. Sensors 116 are preferably inductive type sensors capable of measuring permeability. Sensors 118 are preferably capacitive type sensors capable of measuring permittivity. Further, sensors 116 and 118 can be used in conjunction to measure loss tangent. The sensors can be located as shown, at the input to mixing pump 121. Sensors 116, 118 are also preferably positioned to measure the loss tangent, permittivity and permeability of the fluidic dielectric passing through input conduit 113 and output conduit 114. Note that it is desirable to have a second set of sensors 116, 118 at or near the cavity 109 so that the controller can determine when the fluidic dielectric with updated loss tangent, permittivity and permeability values has completely replaced any previously used fluidic dielectric that may have been present in the cavity 109. Other sensors such as flow meters can be used to determine volumes.

Significantly, when updated conductive fluid is required, any existing conductive fluid must be circulated out of the cavity 109 Any existing conductive fluid not having the proper loss tangent and/or permittivity can be deposited in a collection reservoir 128. The conductive fluid deposited in the collection reservoir can thereafter be re-used directly as a fourth fluid by mixing with the first, second and third fluids or separated out into its component parts so that it may be re-used at a later time to produce additional conductive fluid. The aforementioned approach includes a method for sensing the properties of the collected fluid mixture to allow the fluid processor to appropriately mix the desired composition, and thereby, allowing a reduced volume of separation processing to be required. For example, the component parts can be selected to include a first fluid made of a high permittivity solvent completely miscible with a second fluid made of a low permittivity oil that has a significantly different boiling point. A third fluid component can be comprised of a ferrite particle suspension in a low permittivity oil identical to the first fluid such that the first and second fluids do not form azeotropes. Given the foregoing, the following process may be used to separate the component parts.

A first stage separation process would utilize distillation system 130 to selectively remove the first fluid from the mixture by the controlled application of heat thereby evaporating the first fluid, transporting the gas phase to a physically separate condensing surface whose temperature is maintained below the boiling point of the first fluid, and collecting the liquid condensate for transfer to the first fluid reservoir. A second stage process would introduce the mixture, free of the first fluid, into a chamber 132 that includes an electromagnet that can be selectively energized to attract and hold the paramagnetic particles while allowing the pure second fluid to pass which is then diverted to the second fluid reservoir. Upon de-energizing the electromagnet, the third fluid would be recovered by allowing the previously trapped magnetic particles to combine with the fluid exiting the first stage which is then diverted to the third fluid reservoir.

Those skilled in the art will recognize that the specific process used to separate the component parts from one another will depend largely upon the properties of materials that are selected and the invention. Accordingly, the invention is not intended to be limited to the particular process outlined above.

Figure 2:
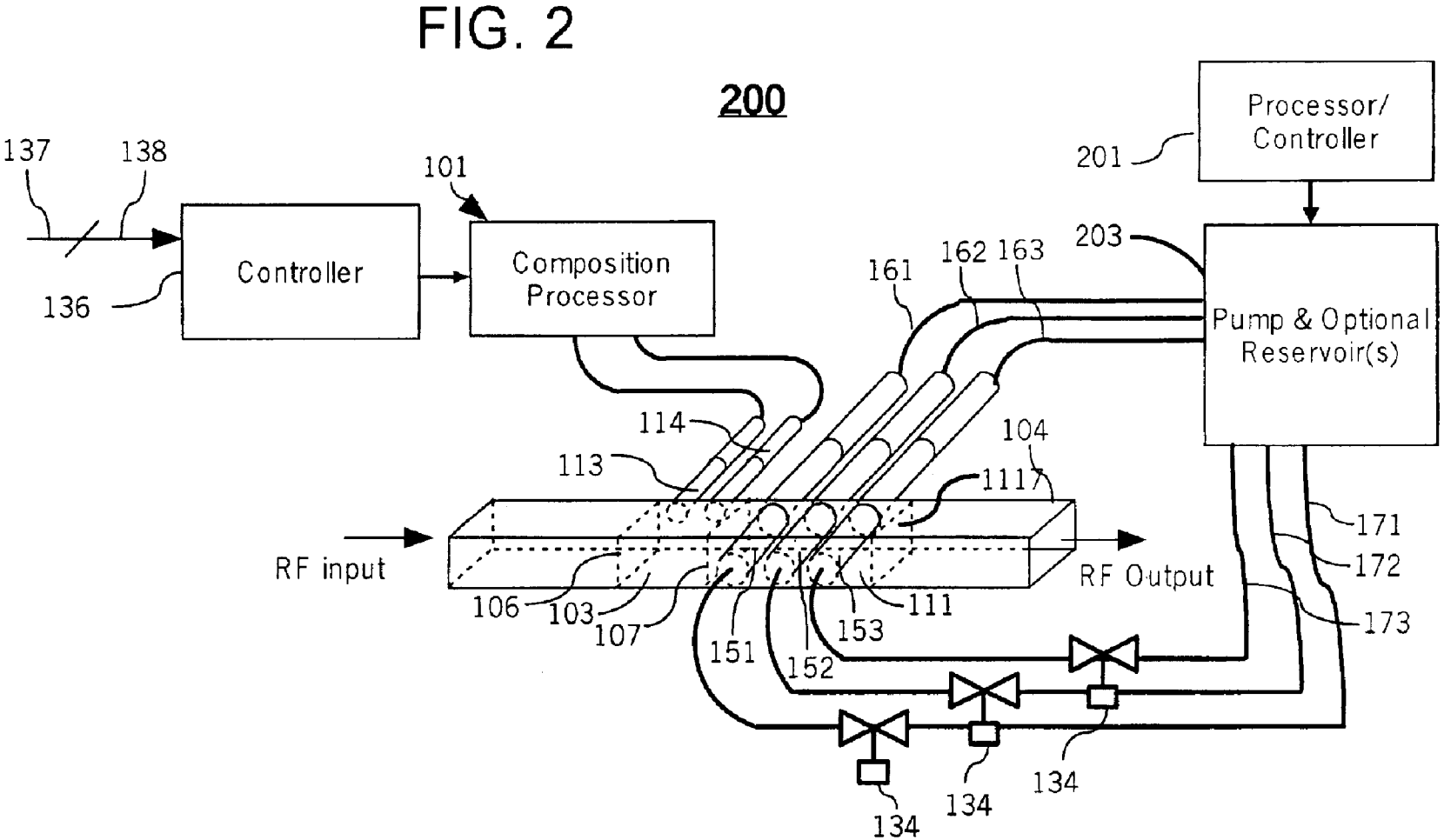
FIG. 2 is a block diagram of another waveguide in accordance with the present invention.

The embodiments of FIGS. 2 and 3 illustrate alternative embodiments. A waveguide apparatus 200 of FIG. 2 in particular illustrates a single system using both mixture or composition control as well volume control. In this instance, a similar controller 136 and composition processor 101 as described with respect to FIG. 1 controls the composition of conductive fluid in a waveguide attenuator region 103 of waveguide 104. Control signal 137 on control input line 138 controls the mixture and/or volume of conductive fluid via input conduit 113 and output conduit 114 within the chamber or cavity defined between walls 106 and 107. Likewise, another waveguide attenuator region 111 defined between walls 107 and 117 includes a plurality of chambers or subcavities 151, 152, and 153. Preferably, these cavities can be a plurality of capillary tubes having a plurality of corresponding input conduits 161, 162 and 162 feeding conductive fluid to the cavities and a plurality of output conduits 171, 172, and 173 providing a means for removing fluidic dielectric from the cavities. The volume control of the fluidic dielectric through the cavities or chambers can be achieved cooperatively using a series of valves 134, a controller 201 for controlling a pump 203 (or pumps) and optional reservoir or reservoirs as shown.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A mode controlled waveguide, comprising:

at least one dielectric wall defining at least one waveguide attenuator cavity, said dielectric wall fluidically isolating said waveguide attenuator cavity from at least one mode propagation region of said waveguide;

a conductive fluid at least partially disposed within at least one among said waveguide attenuator cavity and at least one subcavity within said waveguide attenuator cavity;

at least one composition processor adapted for changing at least one among an electrical characteristic and a physical characteristic of the mode controlled waveguide by manipulating said conductive fluid to vary at least one between a volume and a composition of said conductive fluid disposed in at least one between said waveguide attenuator cavity and said subcavity; and a controller for controlling said composition processor in response to a waveguide mode control signal.

2. The waveguide according to claim 1 wherein said composition processor selectively varies at least one among said volume, said composition, a loss tangent, a permittivity and a permeability within the at least one subcavity in response to said waveguide mode control signal.

3. The waveguide according to claim 1 wherein the waveguide has attenuation and said composition processor selectively varies said volume to vary said attenuation for a predetermined mode.

4. The waveguide according to claim 1, further comprising a second waveguide attenuator cavity.

5. The waveguide according to claim 4, wherein said second waveguide attenuator cavity is at least partially filled with a second conductive fluid.

6. The waveguide according to claim 1 wherein said conductive fluid is comprised of an industrial solvent.

7. The waveguide according to claim 6 wherein said industrial solvent has a suspension of magnetic particles contained therein.

8. The waveguide according to claim 7 wherein said magnetic particles are formed of a material selected from the group consisting of ferrite, metallic salts, and organometallic particles.

9. The waveguide according to claim 7 wherein said industrial solvent contains between about 50% to 90% magnetic particles by weight.

10. A mode controlled waveguide, comprising:

at least one waveguide attenuator cavity;

a conductive fluid at least partially disposed within at least one among said waveguide attenuator cavity and at least one subcavity within said waveguide attenuator cavity;

at least one composition processor adapted for changing at least one among an electrical characteristic and a physical characteristic of the mode controlled waveguide by manipulating said conductive fluid to vary at least one among a volume, a shape, and a composition;

a controller for controlling said composition processor in response to a waveguide mode control signal;

wherein said composition processor selectively varies at least one among said volume, said shape, said composition, a loss tangent, a permittivity, and a permeability within the at least one subcavity in response to said waveguide mode control signal; and wherein the waveguide has an attenuation and said composition processor selectively varies said loss tangent to maintain said attenuation constant as at least one of said permittivity and said permeability is varied.

11. A mode controlled waveguide, comprising:

at least one waveguide attenuator cavity;

a conductive fluid at least partially disposed within at least one among said waveguide attenuator cavity and at least one subcavity within said waveguide attenuator cavity;

at least one composition processor adapted for changing at least one among an electrical characteristic and a physical characteristic of the mode controlled waveguide by manipulating said conductive fluid to vary at least one among a volume, a shape, and a composition;

a controller for controlling said composition processor in response to a waveguide mode control signal;

wherein said composition processor selectively varies at least one among said volume, said shape said composition, a loss tangent, a permittivity and a permeability within the at least one subcavity in response to said waveguide mode control signal; and wherein the waveguide attenuator cavity has a characteristic impedance and said composition processor selectively varies said permeability to maintain said characteristic impedance approximately constant when at least one of said loss tangent, said permittivity, and said volume is varied.

12. A mode controlled waveguide, comprising:

at least one waveguide attenuator cavity;

a conductive fluid at least partially disposed within at least one among said waveguide attenuator cavity and at least one subcavity within said waveguide attenuator cavity;

at least one composition processor adapted for changing at least one among an electrical characteristic and a physical characteristic or the mode controlled waveguide by manipulating said conductive fluid to vary at least one among a volume, a shape and a composition;

a controller for controlling said composition processor in response to a waveguide mode control signal:

wherein said composition processor selectively varies at least one among said volume, said shape said composition, a loss tangent, a permittivity and a permeability within the at least one subcavity in response to said waveguide mode control signal; and wherein the waveguide attenuator cavity has a characteristic impedance and said composition processor selectively varies said permeability to adjust said characteristic impedance.

13. A mode controlled waveguide, comprising:

at least one waveguide attenuator cavity;

a conductive fluid at least partially disposed within at least one among said waveguide attenuator cavity and at least one subcavity within said waveguide attenuator cavity;

at least one composition processor adapted for changing at least one among an electrical characteristic and a physical characteristic of the mode controlled waveguide by manipulating said conductive fluid to vary at least one among a volume, a shape and a composition;

a controller for controlling said composition processor in response to a waveguide mode control signal;

wherein said composition processor selectively varies at least one among said volume, said shape said composition, a loss tangent, a permittivity and a permeability within the at least one subcavity in response to said waveguide mode control signal; and wherein the waveguide attenuator cavity has a characteristic impedance and said composition processor selectively varies said permittivity to maintain said characteristic impedance approximately constant when at least one of said loss tangent, said permeability, and said volume is varied.

14. A mode controlled waveguide, comprising:

at least one waveguide attenuator cavity;

a conductive fluid at least partially disposed within at least one among said waveguide attenuator cavity and at least one subcavity within said waveguide attenuator cavity;

at least one composition processor adapted for changing at least one among an electrical characteristic and a physical characteristic of the mode controlled waveguide by manipulating said conductive fluid to vary at least one among a volume, a shape and a composition;

a controller for controlling said composition processor in response to a waveguide mode control signal;

wherein said composition processor selectively varies at least one among said volume, said shape said composition, a loss tangent, a permittivity and a permeability within the at least one subcavity in response to said waveguide mode control signal; and wherein the waveguide attenuator cavity has a characteristic impedance and said composition processor selectively varies said permittivity to adjust said characteristic impedance.

15. A mode controlled waveguide, comprising:

at least one waveguide attenuator cavity;

a conductive fluid at least partially disposed within at least one among said waveguide attenuator cavity and at least one subcavity within said waveguide attenuator cavity;

at least one composition processor adapted for changing at least one among an electrical characteristic and a physical characteristic of the mode controlled waveguide by manipulating said conductive fluid to vary at least one among a volume, a shape and a composition;

a controller for controlling said composition processor in response to a waveguide mode control signal; and wherein a plurality of component parts are dynamically mixed together in said composition processor responsive to said waveguide mode control signal to form said conductive fluid.

16. The waveguide according to claim 15 wherein said composition processor further comprises a component part separator adapted for separating said component parts of said conductive fluid for subsequent reuse.

17. A mode controlled waveguide, comprising:

at least one waveguide attenuator cavity;

a conductive fluid at least partially disposed within at least one among said waveguide attenuator cavity and at least one subcavity within said waveguide attenuator cavity;

at least one composition processor adapted for changing at least one among an electrical characteristic and a physical characteristic of the mode controlled waveguide by manipulating said conductive fluid to vary at least one among a volume, a shape and a composition;

a controller for controlling said composition processor in response to a waveguide mode control signal; and wherein said composition processor further comprises at least one proportional valve, at least one mixing pump, and at least one conduit for selectively mixing and communicating a plurality of said components of said conductive fluid from respective fluid reservoirs to at least one among said waveguide attenuator cavity and said at least one subcavity.

18. A mode controlled waveguide, comprising:

at least a first and second waveguide attenuator cavity;

a conductive fluid at least partially disposed within at least one among said first waveguide attenuator cavity and at least one subcavity within said waveguide attenuator cavity;

at least one composition processor adapted for changing at least one among an electrical characteristic and a physical characteristic of the mode controlled waveguide by manipulating said conductive fluid to vary at least one among a volume, a shape and a composition;

a controller for controlling said composition processor in response to a waveguide mode control signal;

wherein said second waveguide attenuator cavity is at least partially filled with a second conductive fluid; and further comprising at least a second composition processor adapted for dynamically changing a composition of said second conductive fluid to vary at least one of a volume, a loss tangent, a permittivity and a permeability of said second conductive fluid.

19. A method of controlling the mode of a waveguide comprising the steps of:

providing at least one dielectric wall defining at least one waveguide filter cavity within a waveguide, said dielectric wall fluidically isolating said waveguide attenuator cavity from at least one mode propagation region of said waveguide;

at least partially filling said waveguide filter cavity with a conductive fluid;

propagating said RF signal within said waveguide; and changing at least one among a volume and a composition of said conductive fluid within said waveguide filter cavity to selectively vary at least one of a physical dimension of the waveguide or an electrical dimension of the RF signal in response to a waveguide mode control signal.

20. A method of controlling the mode of a waveguide comprising the steps of:

providing at least one waveguide filter cavity within a waveguide;

at least partially filling said waveguide filter cavity with a conductive fluid;

propagating said RF signal within said waveguide;

changing at least one among a volume and a composition of said conductive fluid to selectively vary at least one of a physical dimension of the waveguide or an electrical dimension of the RF signal in response to a waveguide mode control signal; and wherein the step of varying the electrical dimension of the RF signal comprises selectively varying at least two among a loss tangent, a permittivity and a permeability of the conductive fluid in response to said waveguide mode control signal.

21. A method of controlling the mode of a waveguide comprising the steps of:

providing at least one waveguide filter cavity within a waveguide; at least partially filling said waveguide filter cavity with a conductive fluid; propagating said RP signal within said waveguide;

changing at least one among a volume and a composition of said conductive fluid to selectively vary at least one of a physical dimension of the waveguide or an electrical dimension of the RF signal in response to a waveguide mode control signal; and further comprising the step of dynamically mixing a plurality of components in response to said waveguide mode control signal to produce said conductive fluid.

22. The method according to claim 21 further comprising the step of separating said components into said component parts for subsequent reuse in forming said conductive fluid.

23. The method according to claim 21 further comprising the steps of selectively mixing said components of said conductive fluid from respective fluid reservoirs.

* * * * *